US005150551A

United States Patent [19]

Crom et al.

[11] Patent Number: 5,150,551

[45] Date of Patent: Sep. 29, 1992

[54] PRESTRESSED COMPOSITE CONCRETE TANK WITH IMPROVED PUMP JOINT AND METHOD FOR CONSTRUCTING THE SAME

[75] Inventors: Theodore R. Crom, Hawthorne; Gerald C. Bevis, Archer, both of Fla.

[73] Assignee: The Crom Corporation, Gainesville, Fla.

[21] Appl. No.: 669,063

[22] Filed: Mar. 12, 1991

Related U.S. Application Data

[63] Continuation-in-part of Ser. No. 558,866, Jun. 30, 1990, abandoned.

[51] Int. Cl.[5] ..... E04D 1/00; E04C 3/10

[52] U.S. Cl. ..... 52/223 R; 52/224; 52/249

[58] Field of Search ..... 52/224, 269, 249, 528, 52/583, 223 R

[56] References Cited

U.S. PATENT DOCUMENTS 3,822,520 9/1974 Crom ..... 52/224
4,124,960 11/1978 Bush et al. ..... 52/583

FOREIGN PATENT DOCUMENTS 651724 10/1937 Fed. Rep. of Germany ..... 52/528
728229 4/1955 United Kingdom ..... 52/269

*Primary Examiner*—James L. Ridgill, Jr.
*Attorney, Agent, or Firm*—Staas & Halsey

[57] ABSTRACT

A prestressed composite tank has a vertical wall that extends around a storage area. The wall is made up of a substantially vertical, preferably metallic diaphragm and a layer of shotcrete on one or both sides of the diaphragm. The diaphragm is formed from a series of side-by-side panels, each of which panels has a vertically extending edge portion on each side thereof. The adjacent edge portions of each side-by-side pair of panels are in intimate, mechanical interengagement and subsequently sealed to thereby present fluid impervious joints between the adjacent panels.

23 Claims, 4 Drawing Sheets

PRESTRESSED COMPOSITE CONCRETE TANK WITH IMPROVED PUMP JOINT AND METHOD FOR CONSTRUCTING THE SAME

BACKGROUND OF THE INVENTION

The present application is a continuation-in-part of co-assigned, co-pending application Ser. No. 07/558,866, filed Jun. 30, 1990, now abandoned the entirety of the disclosure of which is hereby specifically incorporated by reference.

FIELD OF THE INVENTION

The present invention relates to prestressed composite tanks having improved water imperviousness characteristics and their construction and, more particularly, to improved vertical joints for joining the diaphragm panels of such tanks to facilitate construction and preclude leaking.

DESCRIPTION OF THE PRIOR ART

The present invention is particularly useful in connection with prestressed composite tanks of the sort described in Letters U.S. Pat. No. 2,370,780 to Crom, in Letters U.S. Pat. No. 3,822,520 to Crom and in Letters U.S. Pat. No. 4,843,778 to Puder, each of which is owned by the assignee of the present application. The entireties of the disclosures of the U.S. Pat. Nos. '780, '520 and '778 are also hereby specifically incorporated herein by reference.

Tanks of the sort disclosed in the U.S. Pat. Nos. '780, '520 and '778 are widely used for storage of liquids and for similar purposes and normally include a light gauge steel shell diaphragm that is encased in layers of cementitious material such as shotcrete. While these tanks have become known as prestressed concrete tanks, the term concrete is used generically and in practice includes shotcrete (which may contain small rocks). The cementitious material that is utilized in connection with the present invention generally consists of a mixture of cement, sand and water, although small rocks might be incorporated into the mixture so long as the same are small enough to flow through the nozzle of the gun.

With the exception of the elongated tanks disclosed in the U.S. Pat. No. '778, known prestressed composite tanks have generally been of circular construction. Thus, after the steel shell is encased in layers of a cementitious material, the outer periphery may be wrapped with prestressing wire which, after tightening, is enclosed by a cover coating of shotcrete. Stretching or tightening of the wire imposes centripetal forces on the wall of the tank and thus, due to the circular configuration of the wall, the entire wall is placed into circumferential compression.

Generally speaking, the shell or diaphragm is constructed of a plurality of side-by-side panels which are fastened together by some sort of vertical joint. Prior to the development of the pumped joint methodology of the U.S. Pat. No. '520, the joints often were in the form of hook joints which were sealed with a mastic or caulking compound. Such sealing operations were not always successful and the tanks occasionally leaked. The pumped joint method of the U.S. Pat. No. '520 provides a much better seal; however, the method requires a great deal of labor and added expense for equipment and supplies. Moreover, a great deal of care is required to avoid damage to the diaphragm joint since the joints are pumped after the concrete is applied to the opposite sides of the diaphragm.

Prior art pumped joints, of the sort described in the U.S. Pat. No. '520, for example, have generally been characterized by the incorporation of a pair of spaced or flared surfaces which present an opening therebetween. The opening may then be closed by a compressible cord (as illustrated in the U.S. Pat. No. '520) or by a piece of tape to thereby form an elongated, usually triangular enclosed channel for pumping. Contamination of such joints has heretofore been a problem because such cord and particularly such tape can be torn or dislodged by accident or as a result of the impingement of shotcrete thereon during shotcreting. In either case contaminating materials are then free to accumulate inside the channel to interfere with the subsequent pumping of the joint and the integrity of the seal.

In such prior art pumped joints, it has also been traditional to construct the diaphragm and then to apply shotcrete to the side of the diaphragm opposite to the channel opening. To preclude plugging of the channel, it has also been conventional to clean the opening prior to installation of the tape or cord used to form the enclosed channel. Such cleaning sometimes breaks the bond between the initial concrete layer and the diaphragm so as to again interfere with the integrity of the joint.

The prior art channels also generally had large openings which needed to be closed by tape thereby presenting expansive cross-sectional areas where the liquid sealant exerted large hydraulic forces on the adjacent concrete layers during pumping. This sometimes resulted in delamination and/or "blow out" of the concrete.

SUMMARY OF THE INVENTION

The problems encountered in the prior art are alleviated through the use of the present invention which provides a prestressed tank comprising a vertical wall extending around a storage area. The wall includes a substantially vertical diaphragm, which may be formed of metal, and preferably a layer of cementitious material is formed on at least one side of the diaphragm. The diaphragm is formed of a plurality of side-by-side vertical panels, each of which has a vertically extending edge portion on each side thereof. The adjacent vertical edge portions of each pair of side-by-side panels are interlocked to assist in holding the panels together during construction and are configured to present a channel extending the entire vertical extent of the interlocked edges. The channels are completely enclosed and surrounded by the edge portions to thereby resist damage and exclude contamination. The channels are then filled with a sealant material to present fluid impervious joints between the panels.

In a preferred form of the invention, the side-by-side vertical panels of the diaphragm extend vertically the entire height of the wall or at least the entire height of the liquid to be contained thereby.

The panels may be formed from light gauge steel and the interlocked pairs of edge portions, which may be formed by bending, may be taped on one or both sides to further exclude contamination. The interlocked edge portions may preferentially be rectangular or square in cross-sectional configuration to minimize the hydraulic forces exerted on adjacent concrete layers during pumping of the liquid sealant.

In another aspect the invention provides a method for constructing a prestressed concrete tank that comprises a wall including a substantially vertical diaphragm that extends around a storage area. In accordance with the invention, the method comprises forming a plurality of elongated vertical panels, each of which has an interlocking joint portion at each longitudinally extending edge thereof. The panels are then erected so as to extend vertically in side-by-side relationship at the periphery of said area to present said diaphragm. The joint portions are configured so that the adjacent edge portions of each pair of side-by-side panels interlock to assist in holding the panels together during said erection step and to present a channel extending the entire vertical extent of the interlocked panels. The channels are completely enclosed and surrounded by said edge portions to thereby resist damage and exclude contamination. The channels are each then filled with a sealant material.

DESCRIPTION OF THE PREFERRED EMBODIMENTS

Figure 1:
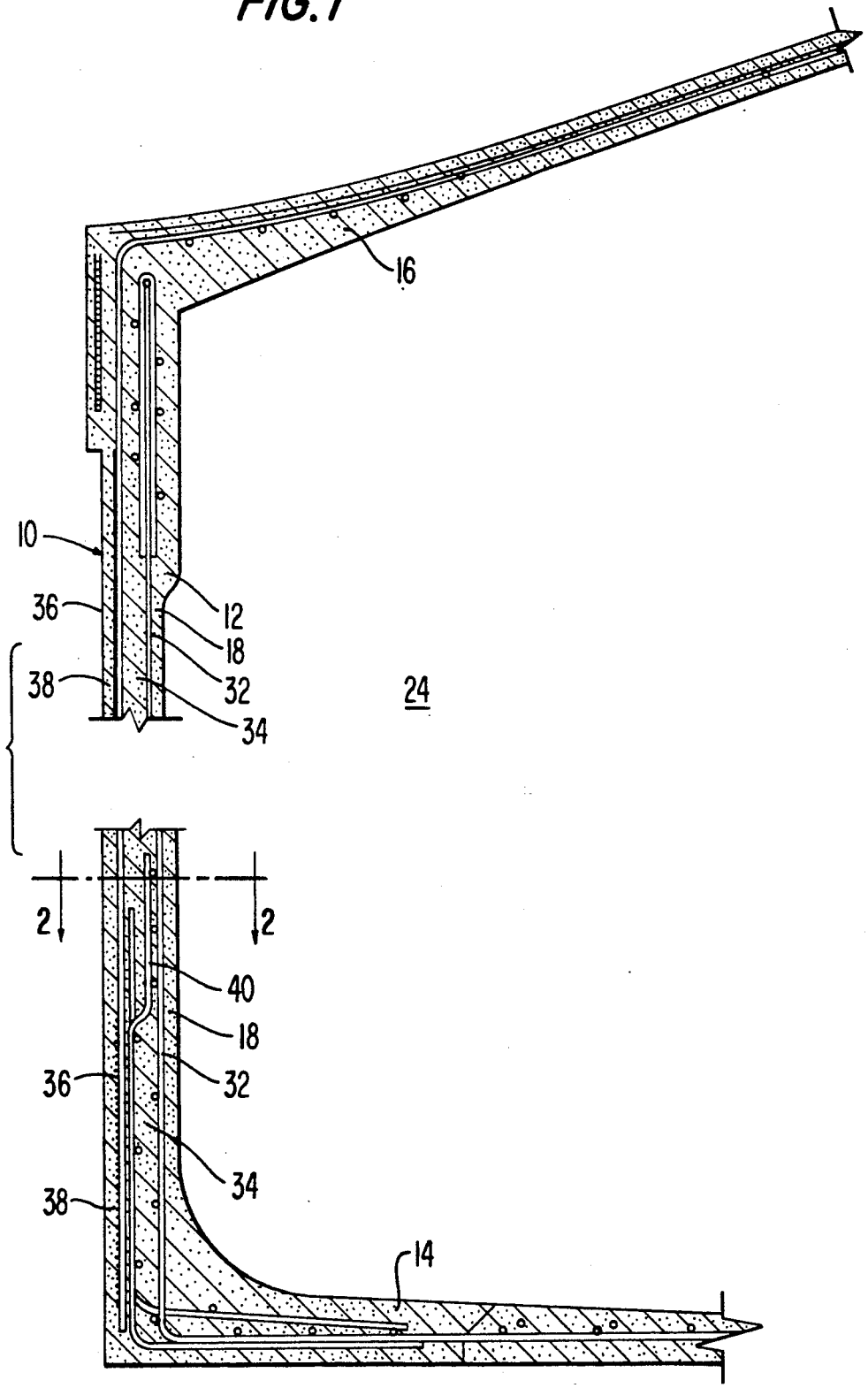
FIG. 1 is a vertical cross-sectional view of a wall of a prestressed composite tank which embodies the principles and concepts of the present invention.

A prestressed concrete tank structure which embodies the concepts and principles of the present invention and which has been constructed utilizing the methodology provided by the present invention is illustrated in FIG. 1 where the tank is broadly identified by the reference numeral 10. The tank 10 is a substantially integral structure which includes a substantially vertical wall 12 and a floor 14, and which may or may not have a roof or dome 16 as illustrated.

Figure 2:
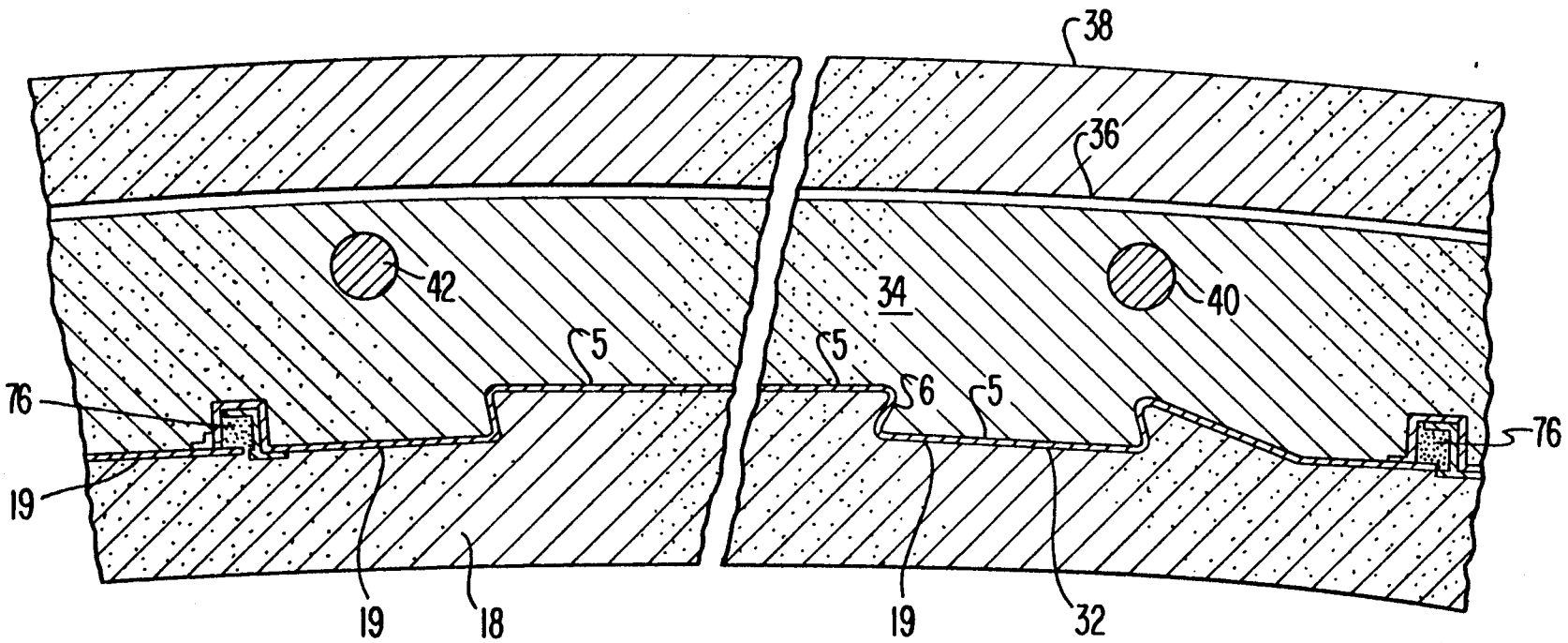
FIG. 2 is a horizontal cross-sectional view taken along the view line 2—2 of FIG. 1.

With reference to FIG. 2, it can be seen that the wall 12 comprises an inner layer 18 of a cementitious material such as shotcrete, a shell or diaphragm generally designated by the reference numeral 32, an intermediate layer 34 of cementitious material, a plurality of passes of prestressing cables, wires, strands or rods 36, or the like, presenting prestressing means wrapped around the intermediate layer 34, and usually a cover layer 38 of cementitious material such as shotcrete or the like.

A plurality of reinforcing rods 40 and 42 may preferably be embedded in the intermediate layer 34 to provide additional support as is well known to those of ordinary skill in the art to which the present invention pertains.

Figure 3:
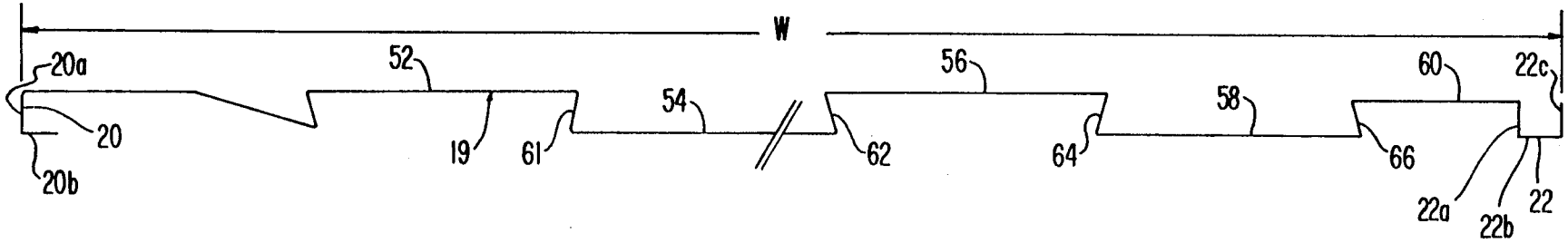
FIG. 3 is a schematic cross-sectional view illustrating the horizontal cross-sectional shape of the diaphragm panels which are a component of the wall of FIGS. 1 and 2.

With reference to FIG. 2, it can be seen that the shell 32 is formed of a plurality of side-by-side vertical panels 19. Each panel 19 initially has a cross-sectional configuration as illustrated in FIG. 3 prior to the construction of the tank. Thus, each panel 19 includes a plurality of planar panel sections 52, 54, 56, 58 and 60 which are interconnected by a plurality of reversely bent connecting portions such as the portions 61, 62, 64 and 66 illustrated in FIG. 3, for example. In this regard, the general shape of the central portions of the diaphragm panels is conventional and is particularly designed to lock into the cementitious material after hardening so as to present a stable, strong, integral structure.

In accordance with the present invention, a respective vertically extending edge portion 20 o 22 is provided at each side of each panel 19. The cross-sectional configuration of the respective edge portions 20, 22 can particularly be seen with reference to FIG. 3. In this regard, it should be noted that FIG. 3 illustrates the panels 19 prior to interlocking of the edge portions. As can be seen in FIG. 3, edge portion 20 may be shaped so as to present vertical strips **20*a* and 20*b*, whereas edge portion 22 may be shaped to present vertical strips 22*a*, 22*b* and 22*c***.

As can be seen viewing FIGS. 1 and 2, the diaphragm 32 is substantially vertical and the same extends essentially all of the way around the tank to present a fluid impervious barrier to prevent leakage of fluid from the storage area 24 defined by the tank 10. Moreover, in the preferred form of the invention, each of the panels 19 which form the diaphragm 32 may preferably extend vertically essentially the entire height of the wall 12 or at least the entire height of the liquid which is to be contained in tank 10.

The panels 19 may preferably be formed from a light gauge steel as is well known to the routineers in the art to which the invention pertains. However, for specialized applications, the panels might just as well be formed from other materials such as, for example, stainless steel, fiberglass or plastic. During the construction of the tank the adjacent vertical edge portions 20 and 22 of each pair of side-by-side panels 19 are brought into an interlocking interengagement as shown in FIG. 4 to assist in holding the panels together during construction.

During the first stages of the assembly, the individual panels 19 of the diaphragm 32 may be supported by suitable false work. The panels 19 are interlocked as illustrated in FIG. 4 to assist in holding panels together during construction. Also, as can be seen in FIG. 4, the vertical strips **20*a* and 20*b* of edge portions 20 and the vertical strips 22*a*, 22*b* and 22*c* of edge portion 22 surround and enclose a channel 70 which extends the entire vertical extent of the interlocked edge portions 20 and 22. In this regard, during assembly of the panels, the edge 22*c*** may be bent slightly inwardly, using pliers or the like, to lock the edges together.

The channel 70 is essentially completely surrounded by end portions 20 and 22 including the strips **20*a*, 20*b*, 22*a*, 22*b* and 22*c* and is sufficient to contain an initially liquid sealant pumped thereinto after completion of the wall 12. However, to assist the channel 70 in containing the sealant, the interlocked pair of edge portions 20 and 22 may be taped with a vertically extending length of tape 72 on one side of the diaphragm and/or a vertically extending length of tape 74 on the other side of the diaphragm 32. Neither of these vertically extending lengths of tape is essential; however, in practice the tape 72 may be more valuable than the length of tape 74 in sealing channel 70**.

Figure 4:
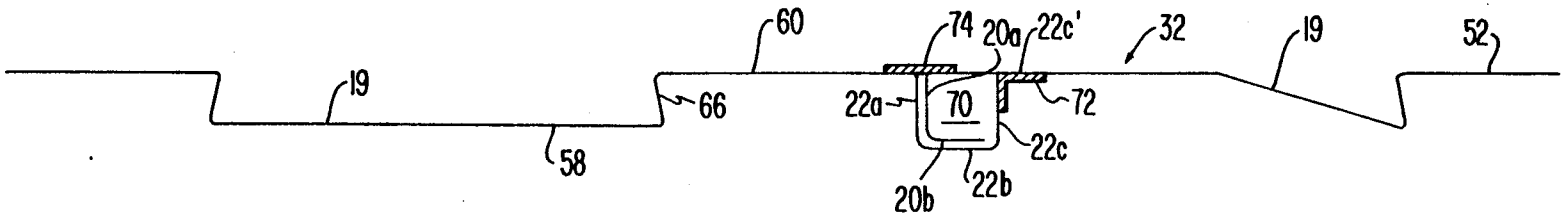
FIG. 4 is an enlarged fragmentary, cross-sectional view similar to FIG. 3 and illustrating the interlocked positioning of the adjacent edge portions of each pair of side-by-side panels presenting a channel.

It should be noted that the relative positioning of the end portions 20 and 22 is illustrated in FIG. 4; however, it is to be understood that FIG. 3 and FIG. 4 are schematic views designed to illustrate the features of the joint and the same are not necessarily drawn to scale. In fact, in actual application, the outer surfaces of strips 20*a* and 20*b* should approximately contact the inner surfaces of strips 22*a* and 22*b* respectively rather than be spaced apart as inferred in FIG. 4.

After intermediate layer 34 has been applied to diaphragm 32 and preferably after all of the concrete has been applied to both sides of the wall, channels 70 may be filled with an appropriate sealant. The wall may be prestressed either before or after filling of the channels with sealant. The sealant may preferably be a two component epoxy sealant having a viscosity sufficiently low to permit pumping of the liquid from the bottom of each channel 70. Pumping is continued until the liquid epoxy appears at the top of each channel 70.

The interlocking of edge portions 20 and 22 provides increased surface area for adherence of sealant on both sides of strips 20*a* and 20*b* while forces exerted on the concrete wall itself are minimized as compared to the prior art.

The sealant ideally should be a low viscosity, two component epoxy resin forming material which contains no solvent and which experiences no shrinkage during setting. These materials are well known and conventionally used in the art and are utilized in a manner which is substantially the same as is fully described in the U.S. Pat. No. '520 referred to above. In this regard, resin input tubes similar to the tubes illustrated in the U.S. Pat. No. '520 may be utilized. Alternatively, and perhaps preferably, a hole may be drilled into channel 70 about 3 inches above the bottom of the channel after the wall is completed and the epoxy may then be applied directly through this small hole. In this regard, the invention does not depend upon the manner in which the channel 70 is filled with epoxy and it is also possible that the epoxy could be applied from the top by dropping a fill tube down through channel 70 from the top and then slowly withdrawing the fill tube as the channel fills with the sealant material. Moreover, channels such as the channel 70 may sometimes need to be pumped in stages, for example, to avoid excessive hydraulic pressures in tall tanks or during cold weather when the viscosity of the sealant is increased and/or where there are interruptions in joints resulting from the presence of manholes or pipe sleeves or the like. With reference to FIG. 2, the sealant material in the final construction is indicated by the reference numeral 76.

The panels 19 may preferably be constructed of 26 gauge steel and in a 300,000 gallon tank having an inside diameter of about 70 feet, the dimension W indicated in FIG. 3 may be approximately 42 inches. Preferably the edge portions 20 and 22 may be formed in the panels 19 by mechanically roll-forming sheets of 26 gauge steel.

Clearly, the interlocking end portions 20 and 22 which fully enclose and surround the channel 70 provide a joint which can be pumped with an epoxy resin to provide a tank which is water tight and of high integrity. The channel 70 may be maintained free of contaminating debris without the use of tape, although taping is recommended because of the inherent lack of precision of the roll forming process. In any event, the tape may be applied prior to the application of shotcrete to either side of the diaphragm, and even if the tape is torn or broken somewhat the risk of contamination entering channel 70 is minimal. Moreover, when the interlocking panels of the present invention are utilized, there is no need to mechanically clean the joint after the first layer of shotcrete is applied.

Preferably, the strips 22*a*, 22*b*, 22*c*, 20*a* and 20*b* should be dimensioned so as to present a square which has a dimension of approximately ½ inch on each side. Also, the edge 22*c*′ of strip 22*c* should preferably be positioned as close to adjacent panel 19 as possible so as to minimize any gap between edge 22*c*′ and the surface of the adjacent diaphragm. In this regard, strips 22*a* and 20*a* and strips 22*b* and 20*b* should be formed so as to essentially touch after the edge portions 20 and 22 are interlocked. Thus, the possibility for contaminating materials to enter channel 70 may be minimized even without use of the tape strips 72 and/or 74.

Figure 5:
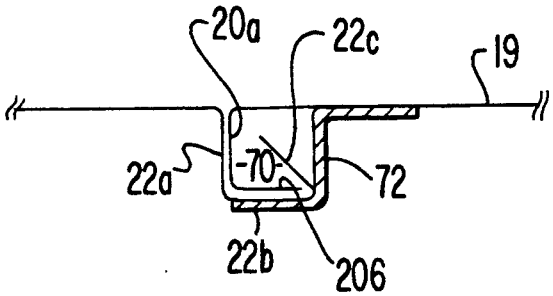
FIGS. 5 and 6 are fragmentary cross-sectional views illustrating alternative configurations for the interlocked edge portions.
Figure 6:
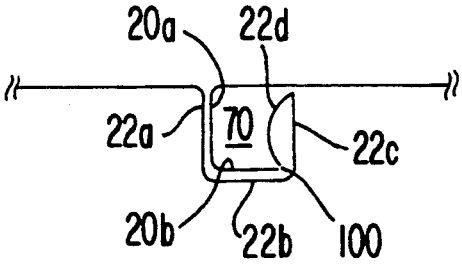

Alternative channel configurations are illustrated in FIGS. 5 and 6. As shown in FIG. 5, the strip 22*c* is bent inwardly at an angle of approximately 45°; however, the angle is not a critical aspect of the embodiment. Tape 72 in FIG. 5 must necessarily be larger than the corresponding tape in FIG. 4 so as to span the resultant gap between the straight portion of panel 19 and the bend line between strips 22*b* and 22*c*. After the layers of shotcrete are applied to the diaphragm, the channel 70 is filled with the sealant material as described previously. As can be seen in FIG. 5, the sealant material will be free to fill the entirety of channel 70 on both sides of strip 22*c*. Moreover, sealant will seep to a certain extent between strips 20*b* and 22*b* so that there will be sealant on both sides of strip 20*b* also. Accordingly, both sides of both diaphragm edges will be completely encased by the sealant after the same solidifies.

The joint configuration illustrated in FIG. 6 provides a snap lock feature. To this end, edge portion 22 is provided with an additional strip 22*d* which may be bowed as illustrated. As edge portions 20 and 22*b* are moved into an interlocking position during the construction procedure, the bowed portion 22*d* is compressed slightly as it is forced past the free end of strip 20*b*. As the edge portions 20 and 22 reach their snugly fitted interlocking relative positions, the free end of strip 22*d* moves past and is released by the free end of strip 20*b* so that strip 22*d* snaps away from strip 22*c* to thereby achieve the relative positioning illustrated in FIG. 6. Such snap lock characteristics will assist in holding the interlocked end portions together during further construction activities. Alternatively, strip 22*d* could be straight and initially disposed at an angle relative to strip 22*c* rather than bowed.

With further regard to FIG. 6, in this embodiment the taping would be similar to the taping illustrated in FIG. 4, and after the shotcrete is applied to the diaphragm, channel 70 will be filled with a sealant as before. As can be seen viewing FIG. 6, the sealant material will be free to flow through the gap 100 and between strips 22*c* and 22*d* and between strips 20*b* and 22*b* so that once again both sides of both diaphragm edges will be encased by the sealant material.

All in all, the joint provided by the present invention, which includes the interlocked vertical edge portions which assist in holding the panels together during construction and which are configured to present a channel extending the entire vertical extent of the interlocked edge portions such that the channels formed by the edge portions are completely enclosed and surrounded thereby, resists damage and excludes contamination. Accordingly the channels may readily be filled with an appropriate sealant material to present fluid impervious joints between the panels. The edge portions inherently are formed from a material which is resistant to mechanical damage during shooting of the shotcrete, and it is not necessary to clean the inside of the joint after shotcreting on one side. Moreover, when joints of the present invention are utilized there is a reduced tendency for the concrete to spall during pumping because of the extremely small cross-sectional areas where the pressurized sealant material may exert forces on the adjacent concrete when pumping pressure is applied. This results in a minimization of the forces on the wall, and therefore the likelihood that the wall will spall or that cementitious wall material will delaminate is greatly reduced.

We claim:

1. In a prestressed composite tank, a vertical wall extending around a storage area, said wall comprising a substantially vertical diaphragm, said diaphragm being formed of a plurality of side-by-side vertical panels, said panels each having a vertically extending edge portion on each side thereof, the adjacent vertical edge portions of each side-by-side panels being interlocked to assist in holding the panels together during construction and being configured to present an initially hollow channel extending the entire vertical extent of the interlocked edge portions, said hollow channels being completely enclosed and surrounded by said edge portions to thereby resist damage and exclude contamination, said wall further including an initially fluid sealant material filling each of said channels, said sealant material having hardened in said channels to thereby present fluid impervious joints between the panels.

2. A prestressed tank as set forth in claim 1, wherein each of said panels extends vertically•the entire height of the wall or at least the entire height of the liquid to be contained by the tank.

3. A prestressed tank as set forth in claim 1, wherein said channels are essentially rectangular in cross-sectional configuration.

4. A prestressed tank as set forth in claim 1, wherein each edge portion includes a free end, and said free ends are configured and positioned to form a snap fit during construction.

5. A prestressed tank as set forth in claim 1, wherein each edge portion includes a free end, and said free ends are configured and positioned so as to be enclosed on both sides by sealant material when the channels are filled.

6. A tank as set forth in claim 1, wherein each interlocked pair of edge portions is taped with a vertically extending length of tape on one side of said diaphragm.

7. A tank as set forth in claim 6, wherein said wall includes a layer of cementitious material on the taped side of the diaphragm.

8. A prestressed tank as set forth in claim 1, wherein said panels are formed from light gauge steel and said edge portions are formed by bending.

9. A prestressed tank as set forth in claim 8, wherein said channels are essentially square in cross-sectional configuration.

10. A tank as set forth in claim 1, wherein each interlocked pair of edge portions is taped with a respective vertically extending length of tape on each side of said diaphragm.

11. A tank as set forth in claim 10, wherein said wall includes a layer of cementitious material on each side of the diaphragm.

12. A tank as set forth in claim 10, wherein said wall includes a layer of cementitious material on at least one side of the diaphragm.

13. A tank as set forth in claim 12, wehrein said wall includes a layer of cementitious material on each side of the diaphragm.

14. A prestressed tank as set forth in claim 10, wherein said channels are essentially square in cross-sectional configuration.

15. In a method of constructing a prestressed composite tank comprising a wall including a substantially vertical diaphragm extending around a storage area, the steps of:

forming a plurality of elongated panels having an interlocking joint portion at each longitudinally extending edge thereof;

erecting said panels so as to extend vertically in side-by-side relationship at the periphery of said area to present said diaphragm, said joint portions being configured so that the adjacent edge portions of each pair of side-by-side panels interlock to assist in holding the panels together during said erection step and to present a hollow channel extending the entire vertical extent of the interlocked panels, said channel being completely enclosed and surrounded by said edge portions to thereby resist damage and exclude contamination therefrom; and filling each of said channels with an initially fluid sealant material and thereafter allowing said sealant material to harden in said channels to present water impervious joints.

16. A method of constructing a tank as set forth in claim 15, wherein is included the step of applying a cementitious material to one side of said diaphragm.

17. A method of constructing a tank as set forth in claim 16, wherein is included the step of applying a cementitious material to both sides of said diaphragm.

18. A method as set forth in claim 15, wherein is included the step of taping each of said interlocked pairs of adjacent edge portions with a vertically extending length of tape on one side of said diaphragm.

19. A method of constructing a tank as set forth in claim 18, wherein is included the step of applying a cementitious material to said one side of said diaphragm.

20. A method as set forth in claim 15, wherein is included the step of taping each of said interlocked pairs of adjacent edge portions with a respective vertically extending length of tape on each side of said diaphragm.

21. A method of constructing a tank as set forth in claim 20, wherein is included the step of applying a cementitious material to both sides of said diaphragm.

22. A prestressed tank as set forth in claim 15, wehrein said panels are formed from light gauge steel and said edge portions are formed by bending.

23. A prestressed tank as set forth in claim 22, wherein said channels are essentially square in cross-sectional configuration.

* * * * *